US006013405A

United States Patent [19]

Takano et al.

[11] Patent Number: 6,013,405

[45] Date of Patent: Jan. 11, 2000

[54] DEVELOPING AGENT AND DEVELOPING DEVICE USING THE SAME

[75] Inventors: Akira Takano, Yokohama; Osamu Ieda, Kawasaki, both of Japan

[73] Assignee: Kabushiki Kaisha Toshiba, Kawasaki, Japan

[21] Appl. No.: 09/017,950

[22] Filed: Feb. 3, 1998

[30] Foreign Application Priority Data

Feb. 7, 1997 [JP] Japan ..... 9-025200

[51] Int. Cl.[7] ..... G03G 9/10

[52] U.S. Cl. ..... 430/110; 430/111; 399/253

[58] Field of Search ..... 430/110, 111, 430/137, 120; 399/253

[56] References Cited

U.S. PATENT DOCUMENTS

| | | | |
|---|---|---|---|
| 4,433,040 | 2/1984 | Niimura et al. | 430/109 |
| 5,439,770 | 8/1995 | Taya et al. | 430/111 |
| 5,712,072 | 1/1998 | Inaba et al. | 430/110 |
| 5,773,185 | 6/1998 | Yachi et al. | 430/137 |

FOREIGN PATENT DOCUMENTS

| | | |
|---|---|---|
| 0 004 748 | 10/1979 | European Pat. Off. . |
| 0 650 097 | 4/1995 | European Pat. Off. . |
| 0 708 376 | 4/1996 | European Pat. Off. . |
| 0 715 230 | 6/1996 | European Pat. Off. . |
| 63-1994 | 1/1988 | Japan . |
| 5-313404 | 11/1993 | Japan . |

OTHER PUBLICATIONS

Junko, "Method for developing Magnetic Brush" *Patent Abstract of Japan* 02306254 (Dec. 19, 1990).

*Primary Examiner*—John Goodrow
*Attorney, Agent, or Firm*—Foley & Lardner

[57] ABSTRACT

A developing agent comprising toner particles and carrier particles, the toner particles including less than 21% of particles having a roundness of less than 0.93, and containing a binder resin, a coloring agent, and an charge controlling agent free from heavy metals.

22 Claims, 2 Drawing Sheets

DEVELOPING AGENT AND DEVELOPING DEVICE USING THE SAME

BACKGROUND OF THE INVENTION

The present invention relates to a two component developing agent containing a non-chromium type charge controlling agent and used in an image-forming apparatus of an electrophotographic system and also relates to a developing device using the same.

In an electrophotographic apparatus or an electrostatic recording apparatus, an electrostatic latent image formed on an electrostatic image holder made of a photoreceptor or a dielectric body is made visible by development with a developing agent of a two component developing system using a toner and a carrier or with a developing agent of a one component system using a toner which also acts as a carrier.

As disclosed in, for example, Japanese Patent disclosure (Kokai) No. 5-313404, a method of preparing a toner comprises in general the step of fusing a mixture of, for example, a thermoplastic resin, a dye, a pigment and other additives such as wax so as to uniformly disperse these components, followed by solidifying under cooling the fused mixture. The solidified mixture is pulverized and, then, classified to obtain colored fine toner particles of a desired particle size.

The dye contained in the developing agent also plays an important role as a charge controlling agent for controlling the electrostatic charging. As disclosed in, for example, Japanese Patent Disclosures Nos. 57-141452 and 58-11049, dyes containing complex compounds of heavy metals, e.g., chromium-containing complex compounds, are widely used as, for example, dyes for electrostatic negative charging. However, heavy metals such as chromium are harmful to human bodies. Therefore, it is of high importance to develop a charge controlling agent which does not contain a heavy metal in view of safety and pollution problem.

Recently, dyes containing iron complex compounds, which are markedly advantageous in safety in the manufacturing process, are disclosed in, for example, Japanese Patent Publication (Kokoku) No. 4-75263.

However, in the case of using a dye containing iron complex compounds which are advantageous in safety, the developing agent is electrostatically charged moderately, compared with the conventional developing agent containing a dye containing heavy metals, leading to a toner dusting problem in, particularly, a high speed developing process.

It should also be noted that the picture image quality is deeply related to the particle diameters of the carrier and toner. Specifically, the image quality can be improved with decrease in the particle diameters of the carrier and toner. However, if these particle diameters are made excessively small, the flowability of the developing agent is impaired, giving rise to problems such as dusting of the toner and thinning in the latter part of the black solid print in the printing test.

BRIEF SUMMARY OF THE INVENTION

An object of the present invention, which has been achieved in view of the situation described above, is to provide a developing agent containing an charge controlling agent free from heavy metals, exhibiting a good flowability, and free from problems such as toner dusting and thinning in the latter part of the black solid print in the printing test so as to obtain a high quality picture image.

Another object is to provide a developing device in which is used a developing agent containing an charge controlling agent free from heavy metals so as to obtain a high quality picture image without bringing about problems such as toner dusting and thinning in the latter part of black solid print in the printing test.

The developing agent of the present invention comprises, the amount of the particles having a roundness of 0.93 or less being at most 21%, toner particles containing a binder resin, a coloring agent, and an charge controlling agent free from heavy metals, and carrier particles mixed in the toner particles.

On the other hand, the developing device of the present invention comprises a developing means arranged to face an image carrier, supporting a developing agent and supplying the supported developing agent onto the image carrier so as to perform development, the developing agent comprising toner particles, the amount of the particles having a roundness of 0.93 or less being at most 21%, containing a binder resin, a coloring agent, and a charge controlling agent free from heavy metals, and carrier particles mixed in the toner particles.

To reiterate, since the roundness of the toner particles are defined, the developing agent of the present invention exhibits a good flowability, and permits obtaining a high quality picture image without bringing about problems such as toner dusting and thinning in the latter part of black solid print in the printing test, though the toner particle contains a charge controlling agent which does not contain heavy metals.

The roundness of the toner particles contained in the developing agent used in the developing device of the present invention is also defined. As a result, the developing agent, which contains an charge controlling agent free from heavy metals, exhibits a good flowability and permits forming a high quality picture image without bringing about problems such as toner dusting and thinning in the latter part of black solid print in the printing test.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

Figure 1:
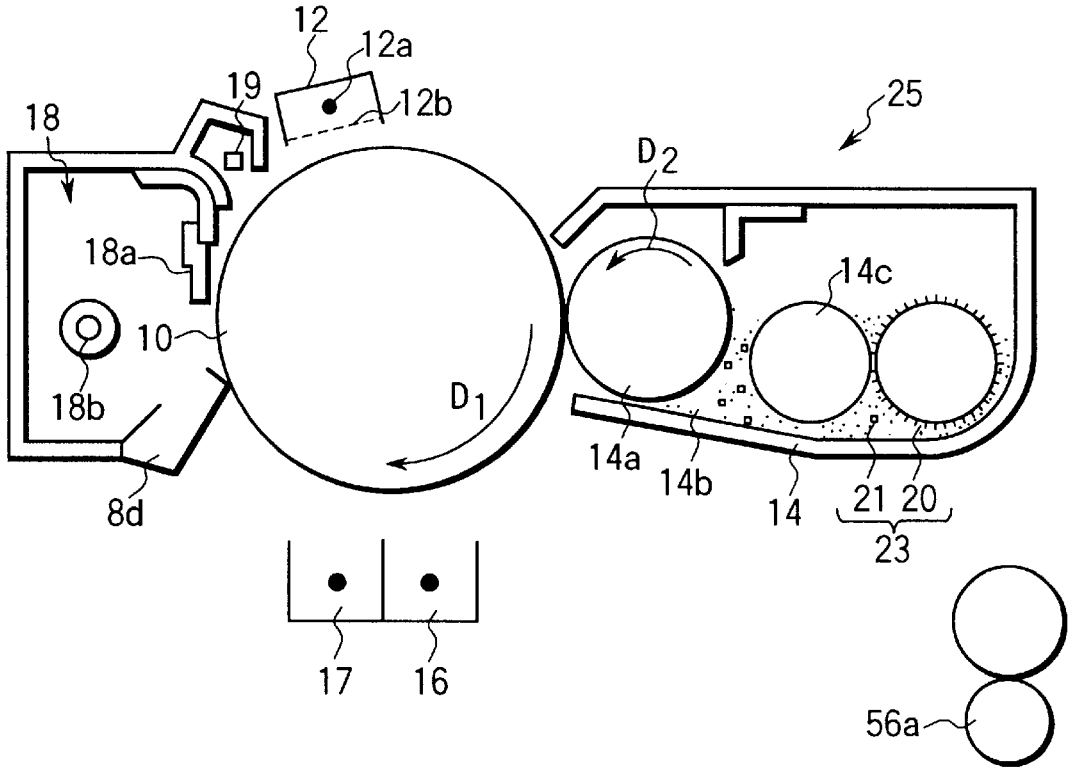
FIG. 1 schematically shows an example of a developing device of the present invention.

The present inventors have conducted an extensive research on a developing agent comprising a toner which does not contain complex compounds of heavy metals, disuse of said complex compounds being advantageous in suppressing pollution problems and in safety of working, in an attempt to overcome the problems inherent in the particular developing agent such as a slow electrostatic charging of the developing agent and dusting of the developing agent. As a result, it has been found that the flowability of the developing agent is deeply related to these problems, and that the roundness of the toner particle greatly contributes to the flowability of the developing agent, leading to the present invention.

The developing agent of the present invention is a two component composition comprising toner particles and carrier particles. The toner particles are such that the amount of the particles having a roundness of 0.93 or less is at most 21%. Also, heavy metals are not used in the charge controlling agent contained in the toner particles.

The present invention also provides a developing device which uses the developing agent of the present invention. The apparatus of the present invention comprises a developing means arranged to face the image carrier, supporting a developing agent and supplying the supported developing agent onto the image carrier so as to perform development, said developing agent comprising toner particles, the amount of the particles having a roundness of 0.93 or less being at most 21%, containing a binder resin, a coloring agent, and a charge controlling agent free from heavy metals, and carrier particles mixed in the toner particles.

As described above, the developing agent of the present invention comprises substantially spherical toner particles which are defined such that the amount of the particles having a roundness of 0.93 or less is at most 21%. The high roundness of the particles facilitates the flowability of the toner particles. As a result, the number of contact times per unit time between the toner particles and the carrier particles is increased. It follows that a larger amount of electrostatic charge is accumulated in both the toner and carrier particles in a shorter time, with the result that the electrostatic charging required for the toner transfer onto the image carrier can be achieved promptly. Naturally, the developing agent of the present invention permits overcoming the problems such as the toner dusting and thinning in the latter part of black solid print.

The flowability of the developing agent is also affected by the diameters of the toner and carrier particles. In recent years, the diameters of the toner and carrier particles tend to be diminished in accordance with demands for a higher image quality and for miniaturization of the developing device. Where the particles are excessively small, it is difficult to ensure a sufficiently high flowability, making it necessary to set the particle diameter appropriately together with the roundness of the particle.

The resolution, which can be a criterion for evaluating the image quality, and the thinning degree in the latter part of solid print, which is caused by a poor flowability resulting from excessively small diameters of the particles used, are closely related to the product between the toner diameter and the carrier diameter and to the roundness of the toner. In the present invention, the product between the toner particle diameter and the carrier particle diameter should fall within a range defined in formula (M1) below:

$$300 \leqq A \cdot B \leqq 500 \quad \text{(M1)}$$

where A is a 50% average diameter ($\mu$m) of the toner particles, and B is a 50% average diameter ($\mu$m) of the carrier particles.

If the product A·B is smaller than 300, the flowability of the developing agent is impaired, giving rise to the toner dusting and thinning in the latter part of the black solid print in the printing test. On the other hand, if the product A·B exceeds 500, fine lines fail to be reproduced sufficiently. Also, since it is necessary to lower the relative toner concentration, the image concentration is also lowered.

In order to improve the image quality and to miniaturize the developing device, the 50% average toner diameter should desirably be 7.0 to 9.0 $\mu$m, and the 50% average carrier particle should desirably be 35 to 90 $\mu$m.

Copolymers of styrene including its derivatives and acrylic resins, which are generally used as a binder resin in the conventional toner can also used in preparing the toner particles contained in the developing agent of the present invention.

The styrene-based copolymers used in the present invention include, for example, polystyrene homopolymer, hydrogenated styrene resin, styrene-isobutylene copolymer, styrene-butadiene copolymer, acrylonitrile-butadiene-styrene terpolymer, acrylonitrile-styrene-acrylic acid ester terpolymer, styrene-acrylonitrile copolymer, acrylonitrile-acrylic rubber-styrene terpolymer, acrylonitrile-chlorinated polystyrene-styrene terpolymer, acrylonitrile-EVA-styrene terpolymer, styrene-p-chlorostyrene copolymer, styrene-maleic acid ester copolymer, and styrene-maleic anhydride copolymer.

On the other hand, the acrylic resins used in the present invention include, for example, polyacrylate, polymethyl acrylate, polyethyl acrylate, poly-n-butyl acrylate, polyglycidyl methacrylate, polyfluoroacrylate, styrene-methacrylate copolymer, styrene-butyl methacrylate copolymer, and styrene-ethyl acrylate copolymer.

The other binder resins used in the present invention include, for example, polyvinyl chloride, polyvinyl acetate, polyethylene, polypropylene, polyester, polyurethane, polyamide, epoxy resin, phenolic resin, urea resin, polyvinyl butyral, polyacrylic acid resin, rosin, denatured rosin, terpene rein, aliphatic or alicyclic hydrocarbon resin, aromatic petroleum resin, chlorinated paraffin, and paraffin wax. These binder resins can be used singly or in the form of a mixture of some of these resins.

The toner particle used in the present invention contains a pigment which is selected from carbon black and organic or inorganic pigments, the carbon black including acetylene black, furnace black, thermal black, channel black and kechen black, though the pigment used in the present invention is not particularly limited. It is desirable for the charge controlling agent to contain an organic material.

The dye used as a charge controlling agent includes, for example, a metal complex compounds represented by structural formula (C1) given below:

(C1)

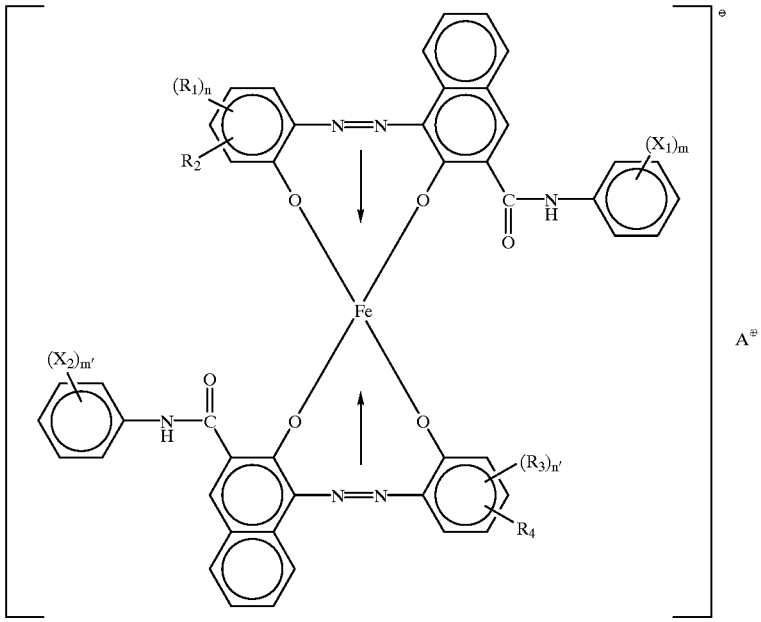

where each of $X_1$ and $X_2$, which may be the same or different, is hydrogen, lower alkyl, lower alkoxy, nitro, or halogen atom; each of m and m' is an integer of 1 to 3; each of $R_1$ and $R_3$, which may be the same or different, is hydrogen, $C_{1-8}$ alkyl, alkenyl, sulfonamide, mesyl, sulfonyl, carboxyester, hydroxy, $C_{1-8}$ alkoxy, acetylamino, benzoylamino or a halogen atom; each of n and n' is an integer of 1 to 3; each of $R_1$ and $R_3$, which may be the same or different, is hydrogen or nitro group; and $A^+$ is hydrogen ion, sodium ion, potassium ion or ammonium ion.

The metal complex compounds exemplified above are likely to be electrostatically charged negative, making it possible to obtain a toner which can be electrostatically charged negative by mixing in a suitable amount these metal complex compounds with the toner particles.

The charge controlling agent used in the present invention also includes, aromatic hydroxy carboxylic acids, aromatic diols, and compounds between aromatic dicarboxylic acid derivatives and iron atoms, as exemplified below:

(C2)

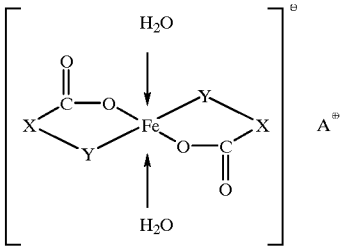

where X denotes

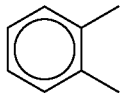

(a substituent such as an alkyl group may be substituted),

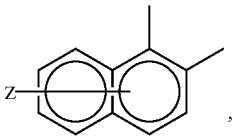

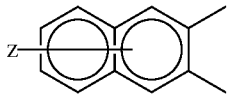

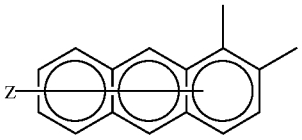

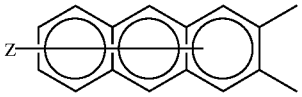

z (Z is a hydrogen atom, a halogen atom or a nitro group),

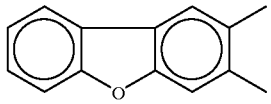

-continued

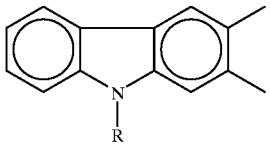

or

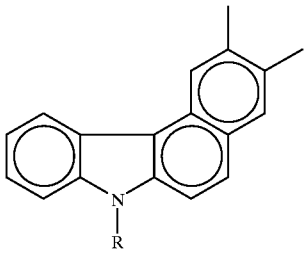

(R is a hydrogen atom, $C_{1-5}$ alkyl or alkenyl;

Y denotes —O— or —C(=O)—O— ; and and $A^{\oplus}$ represent $H^{\oplus}$, $N^{\oplus}$, $NH_4^{\oplus}$ or an aliphatic ammonium.

It is also possible to use N-N'-bistearyl urea derivatives represented by general formula (3) given below and other compounds represented by general formula (4) given below:

(C3)

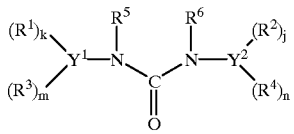

where each of $y^1$ and $y^2$, which may be the same or different, denotes phenyl, naphthyl or anthryl group; each of $R^1$ and $R^2$, which may be the same or different, denotes a halogen atom, nitro group, sulfonic group, carboxyl group, carboxylic acid ester group, cyano group, carbonyl group, alkyl group, alkoxy group, aralkyl group which can have substituent, or amino group; each of $R^3$ and $R^4$, which may be the same or different, denotes a halogen atom, alkyl group, alkoxy group, or aralkyl group which may be substituted; each of $R^5$ and $R^6$, which may be the same or different, denotes a hydrogen atom or a $C_{1-8}$ hydrocarbon group; each of k and j, which may be the same or different, is an integer of 0 to 3, at least one of k and j being not 0; and each of m and n, which may be the same or different, is 1 or 2.

(C4)

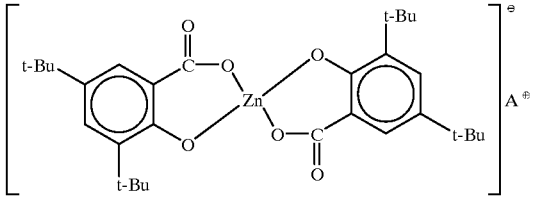

where $A^+$ is as defined previously, and t-Bu denotes t-butyl.

The developing agent of the present invention may also contain waxes for improving the off-set resistance of the agent.

The developing agent of the present invention can be prepared by the known method.

In the mixing and dispersing step included in the preparation of the developing agent, it is possible to use, for example, a wet dispersion method using a high speed dissolver, a roll mill or a ball mill, and a melt kneading method using a roll, a pressure kneader, an internal mixer or a screw type extruder. On the other hand, a ball mill, a V-type mixer, a Folverg, a Henschel mixer, etc. can be used as a mixing means.

For roughly pulverizing the kneaded mass of the mixture, it is possible to use, for example, a hammer mill, a cutter mill, a jet mill, a roller mill or a ball mill. Further, for finely pulverizing the roughly pulverized particles, it is possible to use, for example, a jet mill or a rapid rotation type pulverizer. Still further, the finely pulverized particles can be classified by, for example, a gas stream type classifier.

In the present invention, silica-based fine particles, metal oxide fine particles, cleaning assistants, etc. can be used as external additives to the toner particles. The silica-based fine particles include, for example, particles of silicon dioxide, aluminum silicate, sodium silicate, potassium silicate, zinc silicate, and magnesium silicate. The metal oxide fine particles include, for example, fine particles of zinc oxide, titanium oxide, aluminum oxide, zirconium oxide, strontium titanate, and barium titanate. Further, the cleaning assistant used in the present invention includes, for example, fine powders of resins such as polymethyl methacrylate, and polytetrafluoroethylene. It is possible to apply a surface treatment to these external additives to make these additives hydrophobic.

It is desirable to use, for example, a rapid flowing type mixer such as a Henschel mixer, a super mixer or a microspeed mixer for mixing the external additives, though it is possible to use known mixers.

The roundness of the toner particle can be controlled during or after the pulverizing and classifying steps, or after mixing of the external additives, as follows. Specifically, the roundness can be controlled by a mechanochemical method in which toner particles are put in a rapidly flowing gaseous stream to achieve granulation by the functions of friction, lubrication, melting and fusion, or by a method in which toner particles are put in a thermoplastic gaseous stream to achieve granulation by the functions of melting and fusing. The apparatus used for working such a method includes, for example, a hybridizer, a cryptron, or a mechanofusion.

It is also possible to control the roundness of the toner particle by employing a polymerization method including, for example, an emulsion polymerization, a suspension polymerization, a dispersion polymerization and a solution polymerization. In the polymerization method, monomers of the binder resin, a coloring agent, and other additives are added in each of the steps of dispersion, polymerization, drying, classification and addition of external additives to obtain desired toner particles.

FIG. 1 schematically shows as an example a developing device 14 of the present invention.

As shown in the drawing, the developing device 14 is disposed to face a photoreceptor drum 10 which is rotated by a motor (not shown) in a direction denoted by an arrow $D_1$. Electrostatic latent images corresponding to the image information to be recorded are formed on the surface of the drum 10 by a laser beam emitted from a laser light exposure apparatus which is referred to herein later. Arranged along the circumferential surface of the drum 10 are a charging device 12 for charging the drum 10 to a predetermined potential, the developing device 14 of the present invention for developing the electrostatic latent image formed by the laser light exposure device on the drum 10 by supplying a toner to the latent image, a transfer device 16 for transferring the toner image formed on the drum 10 onto a paper sheet, a cleaning device 18 for removing the toner remaining on the surface of the drum 10, and a static eliminator 19 for eliminating the static charge remaining on the drum surface. These devices 12, 14, 16, 18 and 19 are arranged in this order in the rotating direction denoted by the arrow $D_1$ of the photoreceptor drum 10. The charge eliminator 19 is arranged integrally within the housing of the cleaning device 18. The cleaning device 18 comprises a holder portion for supporting the photoreceptor drum 10 when the drum 10 is mounted in an image-forming apparatus and, thus, is also used as a drum holder.

The charging device 12 comprises a corona wire 12*a* and a grid screen 12*b* and is connected to both a high voltage generating circuit (not shown) and a grid bias voltage generating circuit (not shown) so as to charge the surface of the photoreceptor drum 10 to a predetermined potential.

The developing device 14 comprises a developing roller 14*a*. A two component developing agent 23 comprising a toner 20 and a magnetized carrier 21, which are mixed at a predetermined ratio, is supported on the circumferential surface of the developing roller 14*a*. It should be noted that the toner 20 consists of toner particles, the amount of the particles having a roundness of 0.93 or less being at most 21%, and contains a binder resin, a coloring agent and a charge controlling agent which does not contain heavy metals. It should be noted that the developing roller 14*a* permits the toner alone, which is charged negative, of the developing agent 23 to be attached to the electrostatic latent image formed on the photosensitive drum 10. These developing agent 23 and developing roller 14*a* are arranged within a housing 14*b*.

A guide roller 14*c* is arranged in each of the end portions in the longitudinal direction of the developing roller 14*a* so as to maintain constant the clearance between the surface of a nonmagnetic sleeve forming the outer circumferential surface of the developing roller 14*a* and the photosensitive layer on the surface of the photosensitive drum 10. As a result, the distance between the sleeve surface and the photosensitive layer of the drum 10 is kept constant. Further, a magnetic medium consisting of a plurality of S- and N-stationary magnets disposed a predetermined angular distance apart from each other in the circumferential direction is arranged within the sleeve of the developing roller 14*a*. The particular magnetic medium is rotatable in a direction denoted by an arrow $D_2$.

A predetermined developing bias voltage is applied from a developing bias voltage generating circuit (not shown) to the developing agent 23 attached to the developing roller 14*a* and housed in the developing device 14, said developing agent consisting of the carrier particles 21 and the toner particles 20.

In the step of developing the electrostatic latent image formed on the surface of the photoreceptor drum 10, ears of the carrier particles 21 are aligned normal to the sleeve along the magnetic lines of force generated from the main magnetic poles of the magnetic medium arranged in the developing roller 14*a*. Also, the toner particles attached to the aligned carrier particles by the image force are transferred into a developing region at which the drum 10 faces the developing roller 14*a* so as to develop the latent image. In this step, the toner particles are transferred by the electric field formed by the potential of the electrostatic latent image formed on the surface of the drum 10 and the developing bias voltage.

Let us describe Examples of the present invention.

EXAMPLE 1

The raw materials of composition A shown in Table 1 were melted and kneaded by heating, followed by cooling and pulverizing the kneaded mass and subsequently classifying the pulverized composition to obtain toner particles having a volume average particle diameter of 7.0 $\mu$m and containing 21% of particles having a roundness of 0.93 or less. The charge controlling agent A contained in composition A does not contain heavy metals and contains a metal complex compound represented by structural formula (C1) given previously.

TABLE 1

| Composition A | | Composition B | |
|---|---|---|---|
| Styrene acrylic resin | 90% | Styrene acrylic resin | 90% |
| Carbon black | 5% | Carbon black | 5% |
| Polypropylene wax | 4% | Polypropylene wax | 4% |
| Charge controlling agent A | 1% | Charge controlling agent B | 1% |

The roundness of the toner particle was measured as follows by using a granulometer FPIA-1000 type, which is a trade name of a flow type particle size analyzer developed by Toa Iyo Denshi Inc.

Figure 2:
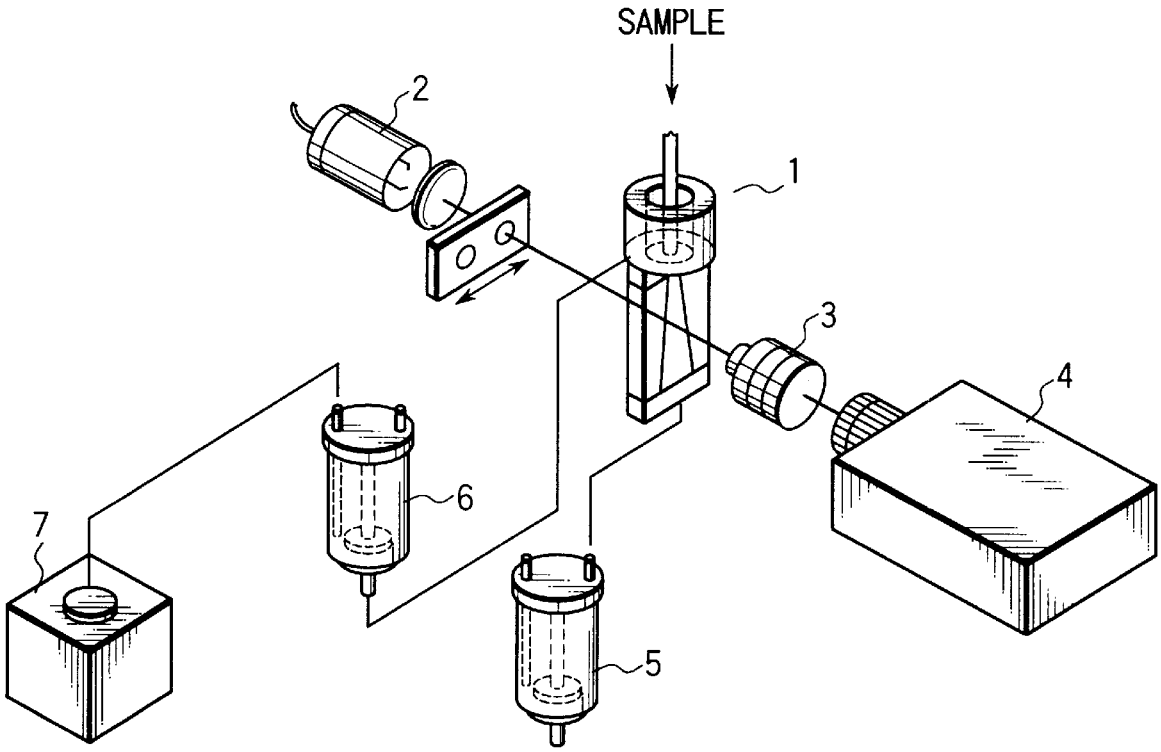
FIG. 2 schematically shows a roundness measuring apparatus used in the present invention.
Figure 3:
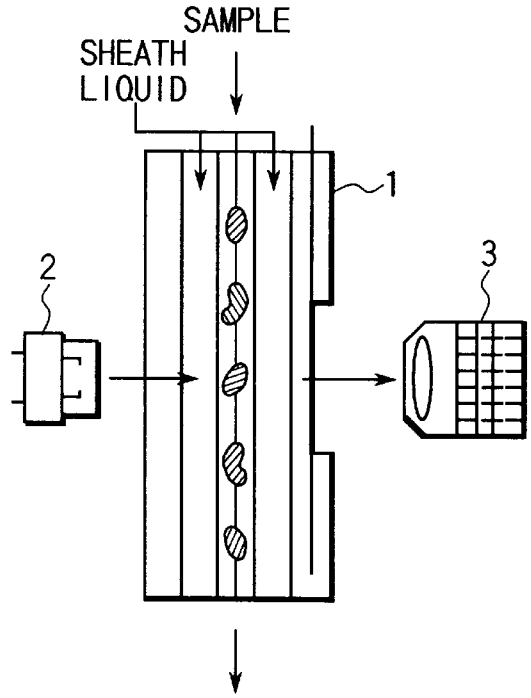
FIG. 3 shows a gist portion of the roundness measuring apparatus shown in FIG. 2.

FIG. 2 schematically shows the roundness measuring apparatus used in the present invention, with FIG. 3 showing the gist portion of the apparatus shown in FIG. 2. As shown in FIG. 2, the measuring apparatus comprises a supply source 7 of a sheath liquid used for the measurement, a sheath liquid chamber 6 for temporarily storing the sheath liquid and supplying a predetermined amount of the sheath liquid, a flat see-through cell 1 receiving a sheath liquid supplied from the sheath liquid chamber 6 and a sample supplied from a supply source (not shown) for forming a sample stream, a waste liquid chamber 5 disposed below the flat see-through cell 1, a stroboscope 2 arranged on one side of the flat see-through cell 1 and emitting light in a constant interval, an objective lens 3 arranged on the opposite side of the flat see-through cell 1, and a CCD camera 4 disposed behind the objective lens 3.

In measuring the roundness, a predetermined amount of a sample suspension prepared by dispersing and suspending toner particles in an aqueous solution of a surface active agent is sucked by a suction pipette. The sucked sample suspension is guided through a sample filter to the flat see-through cell 1. As shown in FIG. 3, a sheath liquid is introduced from the chamber 6 into the flat see-through cell 1, with the result that a flat sample stream is formed by the sheath liquid within the flat see-through cell 1. The sample stream thus formed is sandwiched between two sheath liquid streams and flows through a central portion of the see-through cell 1. As shown in FIG. 2, the sample suspension passing through the flat see-through cell 1 is irradiated with light emitted at a constant interval from the stroboscope 2. The toner particles in the sample suspension are photographed as a stationary image by the CCD camera 4 via the objective lens 3. The images of the photographed particles are analyzed so as to calculate a diameter of an equivalent circle and a roundness from the projected area and circumferential length of the photographed image of the particle, thereby to determine the particle size distribution and the roundness of the particle. The roundness is determined by the formula:

$$R=X/Y \quad (2)$$

where,

R is the roundness;

X is the circumferential length of a circle having an area equal to that of the projected image of the particle; and Y is the actually measured circumferential length of the projected image of the particle.

The amount of particles having a roundness of at most 0.93, which is defined in the present invention, is based on the percentage of the number of particles having the particular roundness.

Then, a toner was prepared by mixing 0.3 part by weight of R-972, which is a hydrophobic silica manufactured by Japan Aerosil Ltd., with 100 parts by weight of the resultant particles. Further, the resultant toner particles and carrier particles having a volume average diameter of 42 μm were put in a ball mill and kept stirred in the ball mill for one hour so as to obtain a developing agent. The value of A·B defined previously, where A is a 50% average diameter (μm) of the toner particles, and B is a 50% average diameter (μm) of the carrier particles, was 294 falling within a range of between 300 and 500 defined in the present invention.

The resultant developing agent was subjected to a toner dusting test and to evaluation of the image quality, as follows:

(1) Toner Dusting

The toner dusting was evaluated by using Leodry 6550, which is a trade name of a copying machine manufactured by Toshiba Corporation. Specifically, a chart of A4 paper size having 6% of image portion was copied on 100,000 paper sheets, followed by observing the state of the toner dusting within the copying machine.

(2) Image Quality

Leodry 6550 was also used for evaluating the image quality. Specifically, test chart No.1-T of the Electrophotographic Institute was copied on 100,000 paper sheets, followed by evaluating the resolution of the copied image so as to determine the image quality. Table 2 shows the result. As apparent from Table 2, the developing agent was found to be quite satisfactory in both the toner dusting level and image quality.

EXAMPLE 2

The raw materials of composition A shown in Table 1 were melted and kneaded by heating, followed by cooling and pulverizing the kneaded mass and subsequently classifying the pulverized composition to obtain particles having a volume average particle diameter of 7.0 μm and containing 21% of particles having a roundness of 0.93 or less.

Then, a toner was prepared by mixing 0.3 part by weight of hydrophobic silica R-972 referred to previously with 100 parts by weight of the resultant particles. Further, the resultant toner particles and carrier particles having a volume average diameter of 60 μm were put in a ball mill and kept stirred in the ball mill for one hour so as to obtain a developing agent. The value of A·B was found to be 420 falling within the range specified in the present invention.

The resultant developing agent was subjected to a toner dusting test and to evaluation of the image quality, as in Example 1, with the results as shown in Table 2. As apparent from Table 2, the developing agent was found to be quite satisfactory in both the toner dusting level and image quality.

EXAMPLE 3

The raw materials of composition A shown in Table 1 were melted and kneaded by heating, followed by cooling and pulverizing the kneaded mass and subsequently classifying the pulverized composition to obtain particles having a volume average particle diameter of 8.7 μm and containing 21% of particles having a roundness of 0.93 or less.

Then, a toner was prepared by mixing 0.3 part by weight of hydrophobic silica R-972 referred to previously with 100 parts by weight of the resultant particles. Further, the resultant toner particles and carrier particles having a volume average diameter of 60 μm were put in a ball mill and kept stirred in the ball mill for one hour so as to obtain a developing agent.

The resultant developing agent was subjected to a toner dusting test and to evaluation of the image quality, as in Example 1, with the results as shown in Table 2. As apparent from Table 2, the developing agent was found to be quite satisfactory in both the toner dusting level and image quality.

As apparent from Examples 1 to 3, the developing agent is quite free from problems in the toner dusting level, image quality and other characteristics, where the toner particles contain not more than 21% of particles having a roundness of 0.93 or less and where the product of the toner diameter (μm) and the carrier diameter (μm) falls within a range of between 294 and 522.

EXAMPLE 4

The raw materials of composition A shown in Table 1 were melted and kneaded by heating, followed by cooling and pulverizing the kneaded mass and subsequently classifying the pulverized composition to obtain particles having a volume average particle diameter of 6.0 μm and containing 21% of particles having a roundness of 0.93 or less.

Then, a toner was prepared by mixing 0.3 part by weight of hydrophobic silica R-972 referred to previously with 100 parts by weight of the resultant particles. Further, the resultant toner particles and carrier particles having a volume average diameter of 42 μm were put in a ball mill and kept stirred in the ball mill for one hour so as to obtain a developing agent.

The resultant developing agent was subjected to a toner dusting test and to evaluation of the image quality, as in Example 1, with the results as shown in Table 2. As apparent from Table 2, the developing agent was found to be quite satisfactory in the image quality. However, the developing agent was found to be somewhat inferior in the toner dusting level to the developing agents prepared in Examples 1 to 3.

EXAMPLE 5

The raw materials of composition A shown in Table 1 were melted and kneaded by heating, followed by cooling and pulverizing the kneaded mass and subsequently classifying the pulverized composition to obtain particles having a volume average particle diameter of 8.7 μm and containing 21% of particles having a roundness of 0.93 or less.

Then, a toner was prepared by mixing 0.3 part by weight of hydrophobic silica R-972 referred to previously with 100 parts by weight of the resultant particles. Further, the resultant toner particles and carrier particles having a volume average diameter of 70 μm were put in a ball mill and kept stirred in the ball mill for one hour so as to obtain a developing agent.

The resultant developing agent was subjected to a toner dusting test and to evaluation of the image quality, as in Example 1, with the results as shown in Table 2. As apparent from Table 2, the developing agent was found to be quite satisfactory in the toner dusting level. However, the developing agent was found to be somewhat inferior in the image quality to the developing agents prepared in Examples 1 to 3.

EXAMPLE 6

The raw materials of composition A shown in Table 1 were melted and kneaded by heating, followed by cooling and pulverizing the kneaded mass and subsequently classifying the pulverized composition to obtain particles having a volume average particle diameter of 8.7 μm and containing 21% of particles having a roundness of 0.93 or less.

Then, a toner was prepared by mixing 0.3 part by weight of hydrophobic silica R-972 referred to previously with 100 parts by weight of the resultant particles. Further, the resultant toner particles and carrier particles having a volume average diameter of 80 μm were put in a ball mill and kept stirred in the ball mill for one hour so as to obtain a developing agent.

The resultant developing agent was subjected to a toner dusting test and to evaluation of the image quality, as in Example 1, with the results as shown in Table 2. As apparent from Table 2, the developing agent was found to be quite satisfactory in the toner dusting level. However, the developing agent was found to be somewhat inferior in the image quality to the developing agents prepared in Examples 1 to 3.

As apparent from Examples 4 to 6, the developing agent is rendered somewhat unsatisfactory in the toner dusting level and image quality where the value of the product A·B where A and B denote the diameters (μm) of the toner particles and the carrier particles, respectively, fails to fall within a predetermined range, even if the amount of the toner particles having a roundness of 0.93 or less is not larger than 21%.

EXAMPLE 7

Particles having a volume average particle diameter of 8.5 μm and containing 18% of particles having a roundness of 0.93 or less were obtained by melting and kneading the composition A shown in Table 1, followed by cooling the kneaded composition and subsequently pulverizing and classifying the composition.

Then, the resultant toner particles and carrier particles having a volume average diameter of 42 μm were put in a ball mill and kept stirred in the ball mill for one hour so as to obtain a developing agent.

The resultant developing agent was subjected to a toner dusting test and to evaluation of the image quality, as in Example 1, with the results as shown in Table 2.

As apparent from Example 7, the developing agent was found to be quite satisfactory in both the toner dusting level and image quality, where the value of A·B defined in the present invention falls within a range of between 292 and 522, and the amount of the toner particles having a roundness of 0.93 or less is not larger than 21%. Particularly, where the value of A·B falls within a range of between 300 and 500, the developing agent was found to be more prominently satisfactory in both the toner dusting level and image quality.

Comparative Example 1

The raw materials of composition A shown in Table 1 were melted and kneaded by heating, followed by cooling and pulverizing the kneaded mass and subsequently classifying the pulverized composition to obtain particles having a volume average particle diameter of 7.2 μm and containing 25% of particles having a roundness of 0.93 or less.

Then, a toner was prepared by mixing 0.3 part by weight of hydrophobic silica R-972 referred to previously with 100 parts by weight of the resultant particles. Further, the resultant toner particles and carrier particles having a volume average diameter of 42 μm were put in a ball mill and kept stirred in the ball mill for one hour so as to obtain a developing agent.

The resultant developing agent was subjected to a toner dusting test and to evaluation of the image quality, as in Example 1, with the results as shown in Table 2. As apparent from Table 2, the developing agent was found to be satisfactory in the image quality. However, the developing agent was found to be inferior in the toner dusting level to the developing agents prepared in Examples 1 to 4.

Comparative Example 2

The raw materials of composition A shown in Table 1 were melted and kneaded by heating, followed by cooling and pulverizing the kneaded mass and subsequently classifying the pulverized composition to obtain particles having a volume average particle diameter of 6.8 μm and containing 25% of particles having a roundness of 0.93 or less.

Then, a toner was prepared by mixing 0.3 part by weight of hydrophobic silica R-972 referred to previously with 100 parts by weight of the resultant particles. Further, the resultant toner particles and carrier particles having a volume average diameter of 60 μm were put in a ball mill and kept stirred in the ball mill for one hour so as to obtain a developing agent.

The resultant developing agent was subjected to a toner dusting test and to evaluation of the image quality, as in Example 1, with the results as shown in Table 2. As apparent from Table 2, the developing agent was found to be somewhat inferior in both the toner dusting level and the image quality.

Comparative Example 3

The raw materials of composition A shown in Table 1 were melted and kneaded by heating, followed by cooling and pulverizing the kneaded mass and subsequently classifying the pulverized composition to obtain particles having a volume average particle diameter of 8.4 μm and containing 25% of particles having a roundness of 0.93 or less.

Then, a toner was prepared by mixing 0.3 part by weight of hydrophobic silica R-972 referred to previously with 100 parts by weight of the resultant particles. Further, the resultant toner particles and carrier particles having a volume average diameter of 60 μm were put in a ball mill and kept stirred in the ball mill for one hour so as to obtain a developing agent.

The resultant developing agent was subjected to a toner dusting test and to evaluation of the image quality, as in Example 1, with the results as shown in Table 2. As apparent from Table 2, the developing agent was found to be satisfactory in the toner dusting level but unsatisfactory in the image quality.

As apparent from Comparative Examples 1 to 3, the developing agent is rendered unsatisfactory in the toner dusting level and the image quality where the toner particles contain 25% of particles having a roundness of 0.93 or less, even if the product of the toner particle diameter (μm) and the carrier particle diameter (μm) falls within a range of between about 300 and about 500.

Comparative Example 4

The raw materials of composition A shown in Table 1 were melted and kneaded by heating, followed by cooling and pulverizing the kneaded mass and subsequently classifying the pulverized composition to obtain particles having a volume average particle diameter of 7.2 μm and containing 30% of particles having a roundness of 0.93 or less.

Then, a toner was prepared by mixing 0.3 part by weight of hydrophobic silica R-972 referred to previously with 100 parts by weight of the resultant particles. Further, the resultant toner particles and carrier particles having a volume average diameter of 42 μm were put in a ball mill and kept stirred in the ball mill for one hour so as to obtain a developing agent.

The resultant developing agent was subjected to a toner dusting test and to evaluation of the image quality, as in Example 1, with the results as shown in Table 2. As apparent from Table 2, the developing agent was found to be satisfactory in the image quality but inferior in the toner dusting level to the developing agents prepared in Examples 1 to 4.

Comparative Example 5

The raw materials of composition A shown in Table 1 were melted and kneaded by heating, followed by cooling and pulverizing the kneaded mass and subsequently classifying the pulverized composition to obtain particles having a volume average particle diameter of 6.7 μm and containing 30% of particles having a roundness of 0.93 or less.

Then, a toner was prepared by mixing 0.3 part by weight of hydrophobic silica R-972 referred to previously with 100 parts by weight of the resultant particles. Further, the resultant toner particles and carrier particles having a volume average diameter of 60 μm were put in a ball mill and kept stirred in the ball mill for one hour so as to obtain a developing agent.

The resultant developing agent was subjected to a toner dusting test and to evaluation of the image quality, as in Example 1, with the results as shown in Table 2. As apparent from Table 2, the developing agent was found to be inferior in both the image quality and the toner dusting level to the developing agents prepared in Examples 1 to 3.

Comparative Example 6

The raw materials of composition A shown in Table 1 were melted and kneaded by heating, followed by cooling and pulverizing the kneaded mass and subsequently classifying the pulverized composition to obtain particles having a volume average particle diameter of 8.2 μm and containing 30% of particles having a roundness of 0.93 or less.

Then, a toner was prepared by mixing 0.3 part by weight of hydrophobic silica R-972 referred to previously with 100 parts by weight of the resultant particles. Further, the resultant toner particles and carrier particles having a volume average diameter of 60 μm were put in a ball mill and kept stirred in the ball mill for one hour so as to obtain a developing agent.

The resultant developing agent was subjected to a toner dusting test and to evaluation of the image quality, as in Example 1, with the results as shown in Table 2. As apparent from Table 2, the developing agent was found to be inferior in both the image quality and the toner dusting level to the developing agents prepared in Examples 1 to 3.

As apparent from Comparative Examples 4 to 6, the developing agent fails to be fully unsatisfactory in the toner dusting level and the image quality where the toner particles contain 30% of particles having a roundness of 0.93 or less, even if the product of the toner particle diameter (μm) and the carrier particle diameter (μm) falls within a range of between about 300 and about 500, no matter how the toner particles and carrier particles may be combined.

Comparative Example 7

The raw materials of composition B shown in Table 1 were melted and kneaded by heating, followed by cooling and pulverizing the kneaded mass and subsequently classifying the pulverized composition to obtain particles having a volume average particle diameter of 6.9 μm and containing 21% of particles having a roundness of 0.93 or less. The charge controlling agent B contained in the composition B consists of a Cr-containing dye, which is a metal complex compound having a chemical structure represented by formula (C5) given below:

(C5)

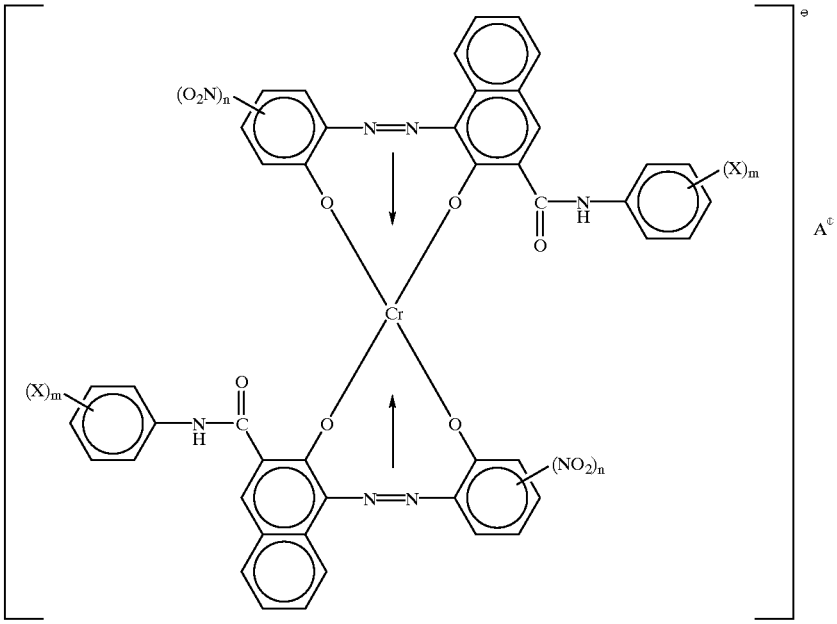

wherein, each of X's, which may be the same or different, denotes a hydrogen atom, a lower alkyl group, a lower alkoxy group, a nitro group or a chlorine atom; n is 1 or 2; m is 1 or 2; and $A^+$ represents a hydrogen ion, a sodium ion, a potassium ion or an ammonium ion.

Then, a toner was prepared by mixing 0.3 part by weight of hydrophobic silica R-972 referred to previously with 100 parts by weight of the resultant particles. Further, the resultant toner particles and carrier particles having a volume average diameter of 60 μm were put in a ball mill and kept stirred in the ball mill for one hour so as to obtain a developing agent.

The resultant developing agent was subjected to a toner dusting test and to evaluation of the image quality, as in Example 1, with the results as shown in Table 2. As apparent from Table 2, no appreciable difference was recognized in each of the image quality and the toner dusting level between the developing agent of Comparative Example 7 and those prepared in Examples 1 to 7. This clearly supports that the developing agents prepared in Examples 1 to 7 can be put to practical use satisfactorily.

TABLE 2

| Examples | Comp. | *4 | A · B *3 | *1 | *2 |
|---|---|---|---|---|---|
| 1 | A | 21 | 294 | ○ | ○ |
| 2 | A | 21 | 420 | ○ | ○ |
| 3 | A | 21 | 522 | ○ | ○ |
| 4 | A | 21 | 252 | Δ | ○ |
| 5 | A | 21 | 609 | ○ | Δ |
| 6 | A | 21 | 696 | ○ | Δ |
| 7 | A | 18 | 408 | ◎ | ◎ |
| 8 | A | 18 | 408 | ◎ | ◎ |
| 9 | A | 17 | 322 | ◎ | ◎ |
| 10 | A | 20 | 490 | ◎ | ◎ |
| Comp. Ex. 1 | A | 25 | 302 | X | ○ |
| Comp. Ex. 2 | A | 25 | 408 | Δ | Δ |
| Comp. Ex. 3 | A | 25 | 504 | ○ | X |
| Comp. Ex. 4 | A | 30 | 302 | X | ○ |
| Comp. Ex. 5 | A | 30 | 402 | Δ | Δ |

TABLE 2-continued

| Examples | Comp. | *4 | A · B *3 | *1 | *2 |
|---|---|---|---|---|---|
| Comp. Ex. 6 | A | 30 | 492 | Δ | Δ |
| Comp. Ex. 7 | B | 21 | 414 | ○ | ○ |

Note:
*1. . . Toner dusting level;
*2. . . Resolution;
○: Excellent
◎: Superior to conventional level in the toner dusting or image quality;
Δ: Equal to conventional level in the toner dusting or image quality;
X: Inferior to conventional level in the toner dusting or image quality;
*3 Roundness (percentage of particles having a roundness of 0.93 or less);
*4 A·B where A is a 50% average diameter (μm) of the toner particles, and B is a 50% average diameter (μm) of the carrier particles.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A developing agent comprising toner particles and carrier particles, said toner particles being obtained by pulverizing a kneaded mass of a toner material, including less than 21% of particles having a roundness of less than 0.93, and containing a binder resin, a coloring agent, and a charge controlling agent free from heavy metals, wherein the product between the toner particle diameter (μm) and the carrier particle diameter (μm) falls within a range defined in the following formula:

$$252 \leqq A \cdot B \leqq 522$$

where A is a 50% average diameter of the toner particles, and B is a 50% average diameter of the carrier particles, and said toner particles have a 50% average particle diameter of 7.0 to 9.0 μm, and said carrier particles have a 50% average particle diameter of 35 to 90 μm.

2. The developing agent according to claim 1, wherein said charge controlling agent is free from chromium.

3. A developing agent comprising toner particles and carrier particles, said toner particles being obtained by pulverizing a kneaded mass of a toner material, including less than 21% of particles having a roundness of less than 0.93, and containing a binder resin, a coloring agent, and a charge controlling agent consisting of a complex compound having one of iron and zinc as a central metal, wherein the product between the toner particle diameter (μm) and the carrier particle diameter (μm) falls within a range defined in the following formula:

$$252 \leqq A \cdot B \leqq 522$$

where A is a 50% average diameter of the toner particles, and B is a 50% average diameter of the carrier particles, and said toner particles have a 50% average particle diameter of 7.0 to 9.0 μm, and said carrier particles have a 50% average particle diameter of 35 to 90 μm.

4. The developing agent according to claim 1, wherein said charge controlling agent comprises an organic-based material as a main component.

5. The developing agent according to claim 1, wherein said charge controlling agent, which is free from a heavy metal, includes a compound represented by structural formula (C1) given below:

(C1)

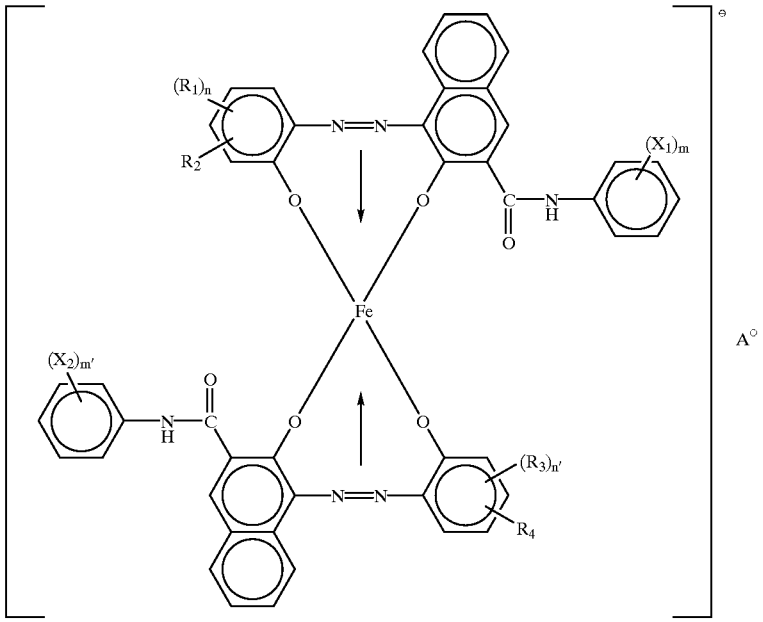

6. The developing agent according to claim 1, wherein said charge controlling agent, which is free from a heavy metal, includes a compound represented by structural formula (C2) given below:

(C2)

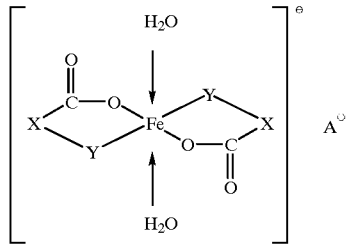

where X denotes

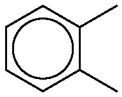

(a substituent such as an alkyl group may be substituted),

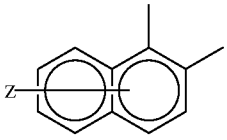

,

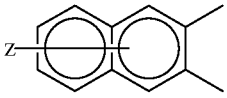

,

-continued

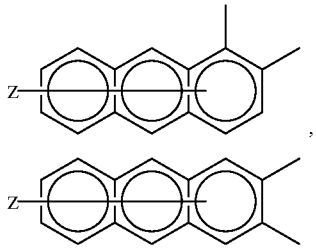

(Z is a hydrogen atom, a halogen atom or a nitro group),

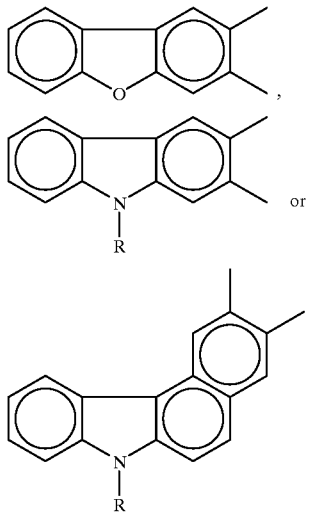

(R is a hydrogen atom, $C_{1-5}$ alkyl or alkenyl;

Y denotes —O— or —C(=O)—O— ; and $A^{\oplus}$ represent $H^{\oplus}$, $Na^{\oplus}$, $NH_4^{\oplus}$ or an aliphatic ammonium.

7. The developing agent according to claim 1, wherein said charge controlling agent, which is free from a heavy metal, includes a compound represented by structural formula (C3) given below:

(C3)

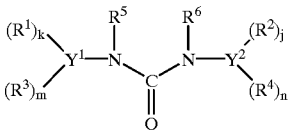

8. The developing agent according to claim 1, wherein said charge controlling agent, which is free from a heavy metal, includes a compound represented by structural formula (C4) given below:

(C4)

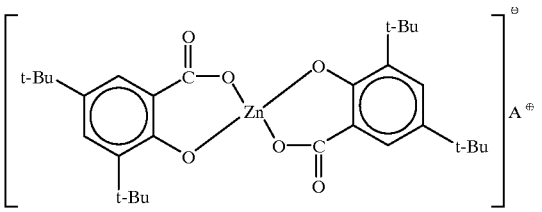

9. The developing agent according to claim 1, wherein said roundness of the toner particle is defined by formula (M1) given below:

$$X/Y \quad \text{(M1)}$$

where:

X is the circumferential length of a circle having an area equal to that of the projected image of the particle; and Y is the actually measured circumferential length of the projected image of the particle.

10. The developing agent according to claim 1, wherein said charge controlling agent the product between the toner particle diameter ($\mu$m) and the carrier particle diameter ($\mu$m) falls within a range defined in formula below:

$$300 \leqq A \cdot B \leqq 500$$

where A is a 50% average diameter of the toner particles, and B is a 50% average diameter of the carrier particles.

11. A developing device comprising developing means arranged to face an image carrier, supporting a developing agent and supplying the supported developing agent onto said image carrier so as to perform development, said developing agent comprising toner particles and carrier particles, said toner particles including at most 21% of particles having a roundness of 0.93 or less, and containing a binder resin, a coloring agent, and an charge controlling agent free from heavy metals.

12. The developing device according to claim 11, wherein said charge controlling agent is free from chromium.

13. The developing device according to claim 11, wherein said charge controlling agent consists of a complex compound having one of iron and zinc as a central metal.

14. The developing device according to claim 11, wherein said charge controlling agent comprises an organic-based material as a main component.

15. The developing device according to claim 11, wherein said charge controlling agent, which is free from a heavy metal, includes a compound represented by structural formula (C1) given below:

(C1)

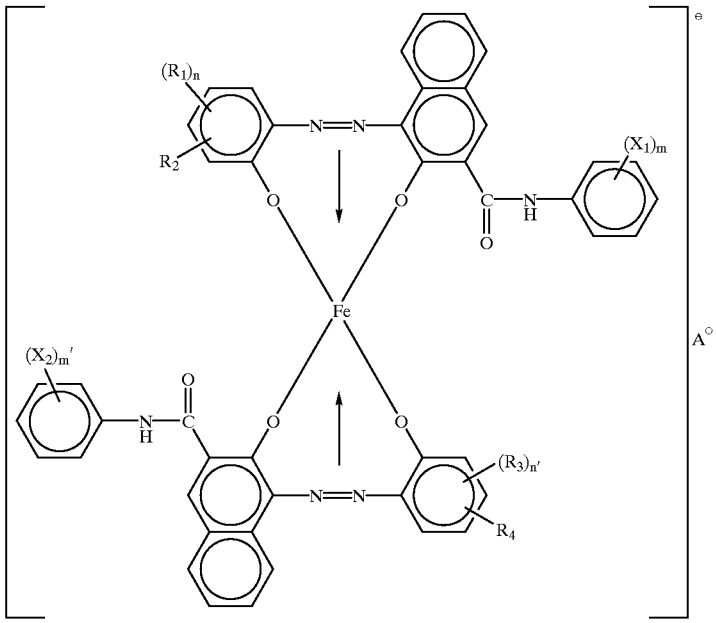

16. The developing device according to claim 11, wherein said charge controlling agent, which is free from a heavy metal, includes a compound represented by structural formula (C2) given below:

(C2)

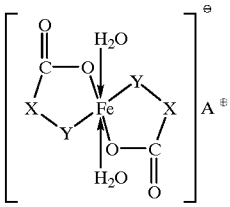

where X denotes

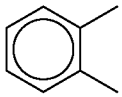

(a substituent such as an alkyl group may be substituted),

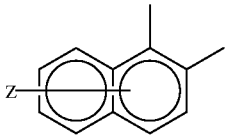

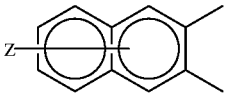

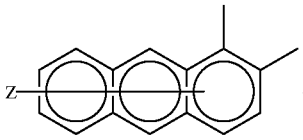

-continued

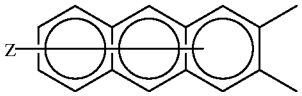

(Z is a hydrogen atom, a halogen atom or a nitro group),

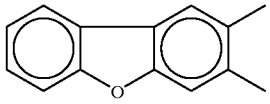

or

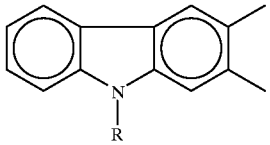

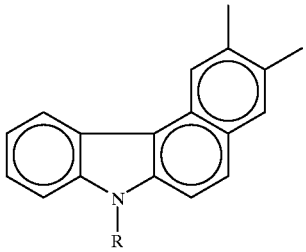

(R is a hydrogen atom, $C_{1-5}$ alkyl or alkenyl;

Y denotes —O— or —C(=O)—O—; and and $A^{\oplus}$ represent $H^{\oplus}$, $Na^{\oplus}$, $NH_4^{\oplus}$ or an aliphatic ammonium.

17. The developing device according to claim 11, wherein said charge controlling agent, which is free from a heavy metal, includes a compound represented by structural formula (C3) given below:

(C3)

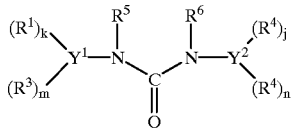

18. The developing device according to claim 11, wherein said charge controlling agent, which does not contain a heavy metal, includes a compound represented by structural formula (C4) given below:

(C4)

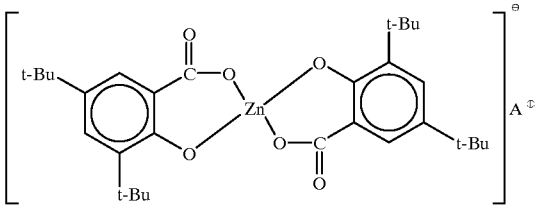

19. The developing device according to claim 11, wherein said roundness of the toner particle is defined by formula (M1) given below:

$$X/Y \quad \text{(M1)}$$

where

X is the circumferential length of a circle having an area equal to that of the projected image of the particle; and Y is the actually measured circumferential length of the projected image of the particle.

20. The developing device according to claim 11, wherein said charge controlling agent the product between the toner particle diameter ($\mu$m) and the carrier particle diameter ($\mu$m) falls within a range defined in formula below:

$$300 \leqq A \cdot B \leqq 500$$

where A is a 50% average diameter of the toner particles, and B is a 50% average diameter of the carrier particles.

21. The developing device according to claim 11, wherein said charge controlling agent the product between the toner particle diameter ($\mu$m) and the carrier particle diameter ($\mu$m) falls within a range defined in formula below:

$$252 \leqq A \cdot B \leqq 522$$

where A is a 50% average diameter of the toner particles, and B is a 50% average diameter of the carrier particles.

22. The developing device according to claim 20, wherein a 50% average diameter of the toner particles falls within a range of between 7.0 and 9.0 $\mu$m, and a 50% average diameter of the carrier particles falls within a range of between 35 and 90 $\mu$m.

* * * * *